US005480141A

United States Patent [19]

Wood

[11] Patent Number: 5,480,141

[45] Date of Patent: Jan. 2, 1996

[54] HITTING PRACTICE APPARATUS

[76] Inventor: David G. Wood, 7913 N. McKee Blvd., Oklahoma City, Okla. 73132

[21] Appl. No.: 299,158

[22] Filed: Aug. 31, 1994

[51] Int. Cl.[6] ..... A63D 15/10

[52] U.S. Cl. ..... 273/26 E; 273/58 C; 273/197 A

[58] Field of Search ..... 273/26 E, 29 A, 273/58 C, 26 EA, 184 B, 185 C, 185 D, 196, 197 R, 20 DR, 200 B, 197 A

[56] References Cited

U.S. PATENT DOCUMENTS

| | | | |
|---|---|---|---|
| 149,908 | 4/1874 | Baldwin | 273/58 C |
| 667,563 | 2/1901 | Oakley | 273/58 C |
| 3,086,775 | 4/1963 | Albert | 273/26 EA |
| 3,934,873 | 1/1976 | Griffin | 273/58 C |
| 4,496,156 | 1/1985 | Gentafanti | 273/184 B |
| 4,696,472 | 9/1987 | Meyer | 273/58 C |
| 5,060,946 | 10/1991 | Taylor | 273/58 C |

FOREIGN PATENT DOCUMENTS

| | | | |
|---|---|---|---|
| 2107592 | 5/1983 | United Kingdom | 273/184 B |

OTHER PUBLICATIONS

Advertisement, Daily Oklahoman newspaper.

*Primary Examiner*—Theatrice Brown
*Attorney, Agent, or Firm*—Gary Peterson

[57] ABSTRACT

A hitting practice apparatus consists of a stand which supports a telescoping tower of adjustable height. The tower in turn supports a horizontal support arm, upon which a oval-shaped rotation element is pivotally mounted. A ball suspension cable is connected at one of its ends to the rotation element, and at its other end to a ball element having an internal passage through which the cable may be clearingly received. An elongate plug element is implanted within the ball element. An enlarged cable stop element, to which the lower end of the ball suspension cable is secured, is positioned within an internal chamber with the implanted plug element.

12 Claims, 2 Drawing Sheets

HITTING PRACTICE APPARATUS

FIELD OF THE INVENTION

The present invention relates generally to the field of athletic training equipment, and more particularly to the field of practice equipment for the hitting of baseballs and softballs.

SUMMARY OF THE INVENTION

The present invention comprises a hitting practice apparatus, formed from a rotation element, which is pivotally supported on a horizontal support arm. A ball suspension cable is secured at one of its ends to the rotation element, and at its other end to a ball element.

Formed within the ball element is an axial internal passage, through which the ball suspension cable is clearingly extended. A lower cable stop element is secured to the lower end of the ball suspension cable and is clearingly received within an enlarged internal chamber within the internal passage. The lower cable stop element has a cross-sectional dimension exceeding that of the more constricted dimensions of the internal channel, while permitting rotation of the ball element with respect to the lower cable stop element and ball suspension cable.

DETAILED DESCRIPTION OF THE PREFERRED EMBODIMENTS

Figure 1:
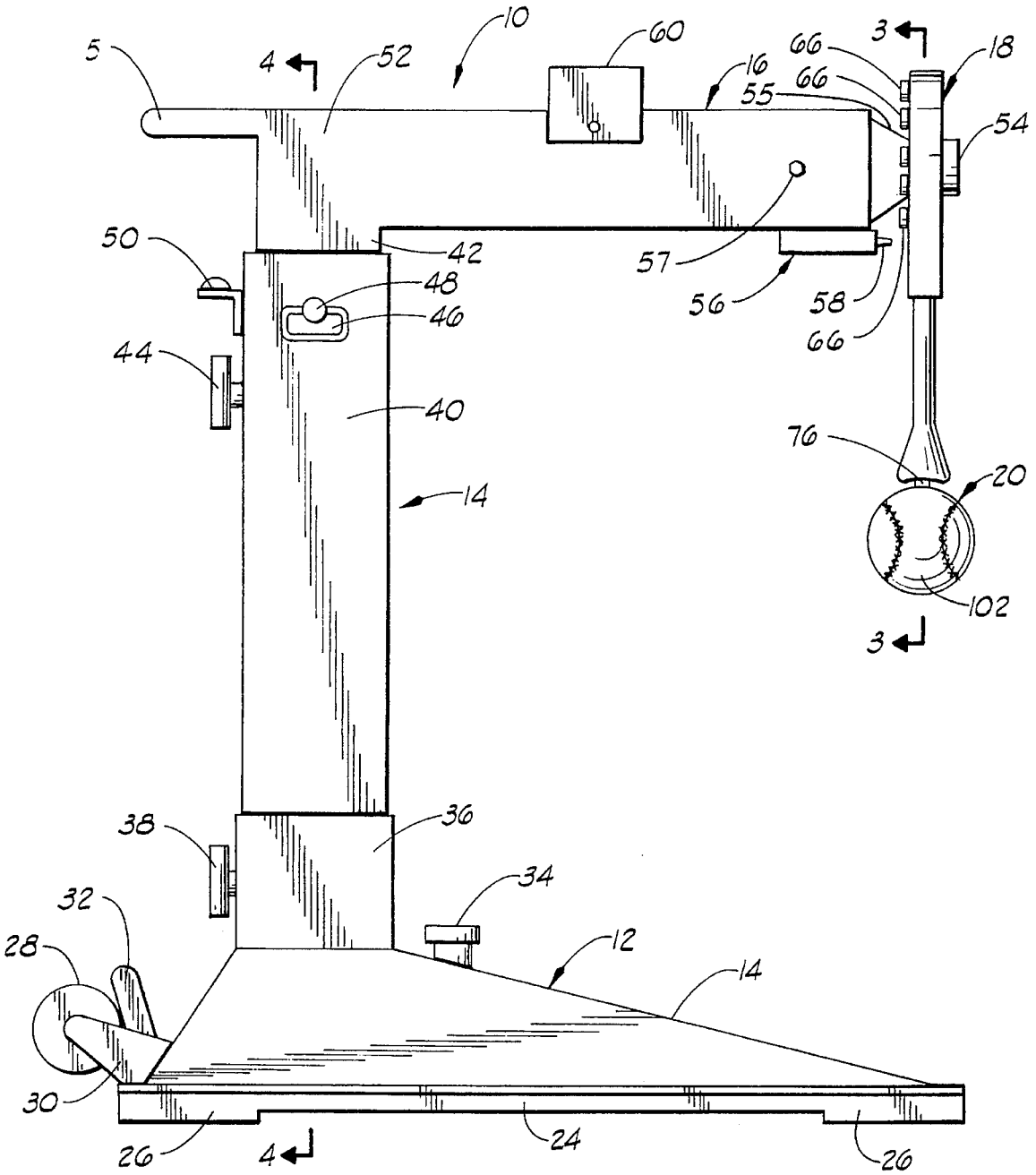
FIG. 1 is a side elevational view of the hitting practice apparatus of the present invention, in which the ball element is softball-sized.

With initial reference to FIG. 1, the hitting practice apparatus of the present invention is designated by reference numeral 10. The major components of the invention include a stand assembly 12, which supports a telescoping tower assembly 14. The tower assembly 14 in turn supports a horizontal support arm 16, which may be integral with one of the telescoping elements of the tower assembly 14. Pivotally installed on the free end of the support arm 16 is a rotation element 18, from which a ball element 20 depends.

Figure 4:
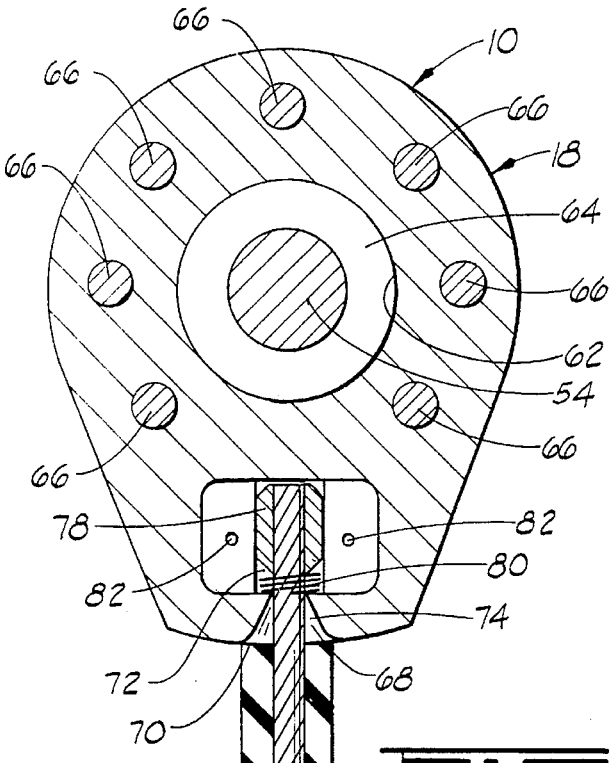
FIG. 4 is another side cross sectional view of the hitting practice, taken along the line 4—4 shown in FIG. 1.

With reference to FIGS. 1 and 4, the stand assembly 12 preferably comprises a hollow body 22, and may be formed from a strong and durable material such as steel, aluminum, or thermoplastic. The body 22 is characterized by a substantially flat base 24, and preferably is supported by one or more ground-contacting pad elements 26, formed from rubber or a similar friction-resistant material. The pad elements 26 function to stabilize the apparatus 10, and prevent its slippage or movement when the apparatus 10 is struck during use.

As best shown in FIG. 1, at least one, and preferably a plurality of rollers 28 are rotatably supported on an equal number of C-shaped frame elements 30, which project rearwardly from the body 22. When the assembled apparatus 10 is tilted to the rear, the rollers 28 engage the ground, thereby permitting the assembled apparatus 10 to be rolled from location to location. The stand assembly 14 preferably is further equipped with a lower handle 32, in order to permit easy movement of the stand assembly 12 when the apparatus 10 is in its disassembled state.

With continued reference to FIG. 1, the body 22 preferably is provided with an external ballast port 34, which communicates with the hollow interior of the body 22. The port 34 may be used to fill the interior of the body with a ballast material, such as sand or water, which functions to stabilize the apparatus 10 against slippage or movement while in use.

As shown in FIGS. 1 and 4, the stand assembly 12 preferably further comprises a tubular upright standard 36, which is received within an upper opening within the body 22. The standard 36 is secured, preferably by welding or a similar bonding process, to the base 24. Formed within the standard 36 are at least one, a preferably a plurality of vertically spaced apertures (not shown), which most preferably are threaded. A bolt 38 may be threaded through one of these apertures in order to engage and position the tower assembly 14, as will be described hereafter.

With continued reference to FIGS. 1 and 4, the tower assembly 14 comprises a lower section 40 and an upper section 42, both of which are preferably tubular and formed from a sturdy and durable material such as aluminum or steel. The cross-sectional dimensions of the upper and lower sections 40 and 42 are such that at least a portion of the upper section 42 may be clearingly received within the lower section 40. The telescoping relationship of the two sections 40 and 42 permits the height of the tower assembly 14 to be adjusted, as required to accommodate users of different heights.

As best shown in FIG. 4, the lower section 40 of the tower assembly 14 is vertically positioned within the standard 36. The bolt 38 engages the outer wall of the lower section 40, and holds the lower section in fixed relationship to the standard 36. The vertical positioning of the lower section 40 may be adjusted by loosening and retightening the bolt 38.

A plurality of vertically spaced and threaded apertures (not shown) are formed within the lower section 40, adjacent its upper end. As shown in FIG. 1, a bolt 40, preferably identical to the bolt 38, may be threaded through one of these apertures, into engagement with the outer wall of the inner section 42, thereby maintaining the lower and upper sections 40 and 42 in fixed relationship.

Adjacent its upper end, a pair of opposed pin openings 44 (one of which is shown in FIG. 1) are formed in the walls of the lower section 40. A plurality of vertically spaced pairs of opposed pin openings (not shown) are similarly formed in the walls of the upper section 42. Selected pin opening pairs in the lower and upper sections may be aligned by telescoping the upper section 42 within the lower section 40. A pin 48 may be inserted through the aligned pin openings, in order to fix the relative position of the lower section 40 and the upper section 42.

In operation, the tower assembly 14 is ordinarily configured by inserting lower section 40 into the standard 36, after which the bolt 38 is tightened. With the pin 48 removed, the upper section 42 is telescopingly received with the lower section 40. When the upper section 42 is positioned at a desired height, registering pairs of pin openings are aligned in the lower and upper sections 40 and 42. The pin 48 then is inserted through the aligned pin openings. Finally, the upper bolt 44 is tightened.

The tower assembly 14 preferably further comprises a sight level 50, installed adjacent the upper end of the lower section 40. The level 50 assists the user in positioning the stand assembly 12 apparatus 10 in the preferred horizontal position on ground level.

With continued reference to FIG. 1, the support arm 16 comprises a tubular member formed from a sturdy and durable material such as aluminum or steel. In the embodiment shown in the Figures, the support arm 16 is integrally formed with the upper section 42 of the tower assembly. In this embodiment, best shown in FIG. 1, the integral support arm 16 and upper section 42 comprise the arms of an L-shaped tubular member 52. A handle 5 is installed on the member 52, in order to facilitate transport of the apparatus 10 in its assembled and disassembled states.

In another embodiment of the invention, not shown in the Figures, the stand assembly 12 and tower assembly 14 may be eliminated, and the support arm secured directly to a vertical post or pole, such as that used to hold a basketball goal. The support arm includes a U-shaped frame having opposed pin openings. These pin openings are aligned with a corresponding pair of pin openings in the post and the frame is secured to the post by a pin extending through the aligned openings.

In another embodiment not shown in the Figures, the tower assembly is retained, but is embedded directly into the ground, so that the stand assembly is not required for stabilization. In such an embodiment, the tower assembly height may be adjusted by telescoping the upper and lower sections, as described with reference to FIG. 1. The support arm may be secured to the tower assembly by means of a pin connection, as described above.

With reference to FIG. 1, the horizontal support arm 16 is tapered at the end most distant from the tower assembly 14, and terminates in a cylindrical shaft 54. Most preferably, the horizontal support arm 16 is hollow at the end most distant from the tower assembly 14. The shaft 54 is formed in a separate terminal block 55, which may be clearingly received within the hollow of the horizontal support arm 16. The terminal block 55 is held in place by a bolt 57 which extends transversely through registering apertures formed in the terminal block 55 and support arm 16.

Supported on the support arm 16, adjacent the shaft 54, is a measurement assembly 56 comprising a sensor element 58. As shown in the Figure, the measurement assembly 56 is covered with a cowling, in order to protect its components from accidental impact during use of the apparatus 10.

Figure 2:
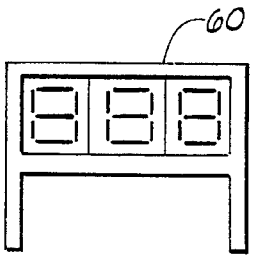
FIG. 2 is an exploded elevational view of the computation assembly 60 shown in FIG. 1, depicted as separate and detached component.

Also supported on the support arm 16, preferably at a readily visible point thereon, is a computation assembly 60. The computation assembly 60, which is shown as a separate and detached component in FIG. 2, is operatively connected to the measurement assembly 56, preferably by a conductor (not shown), and is responsive to signals from the measurement assembly 56.

Figure 3:
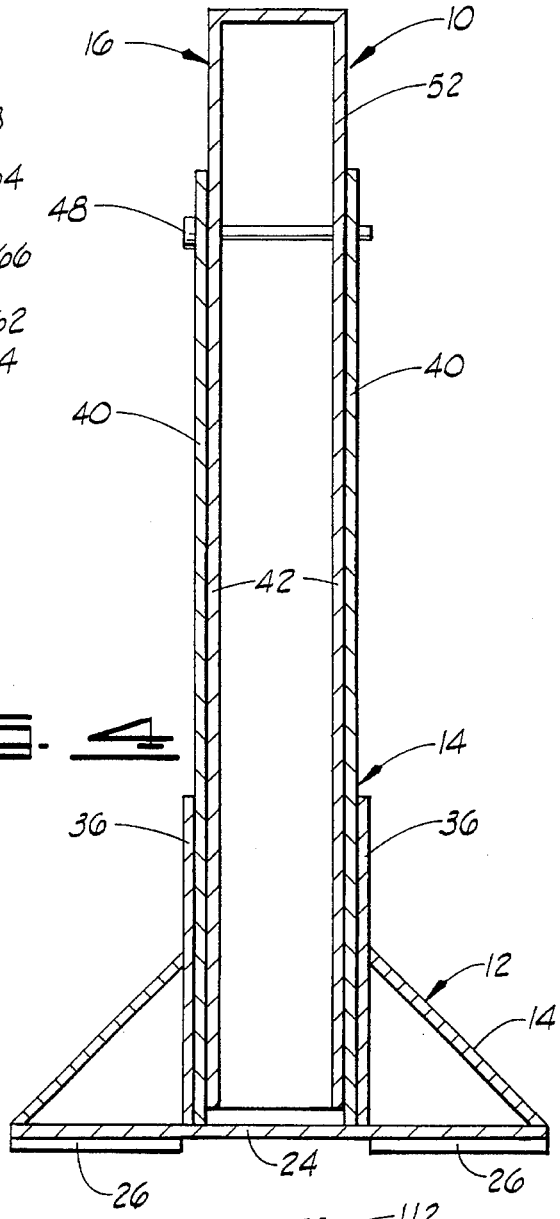
FIG. 3 is a side cross-sectional view of the hitting practice apparatus, taken along the line 3—3 shown in FIG. 1.
Figure 3:
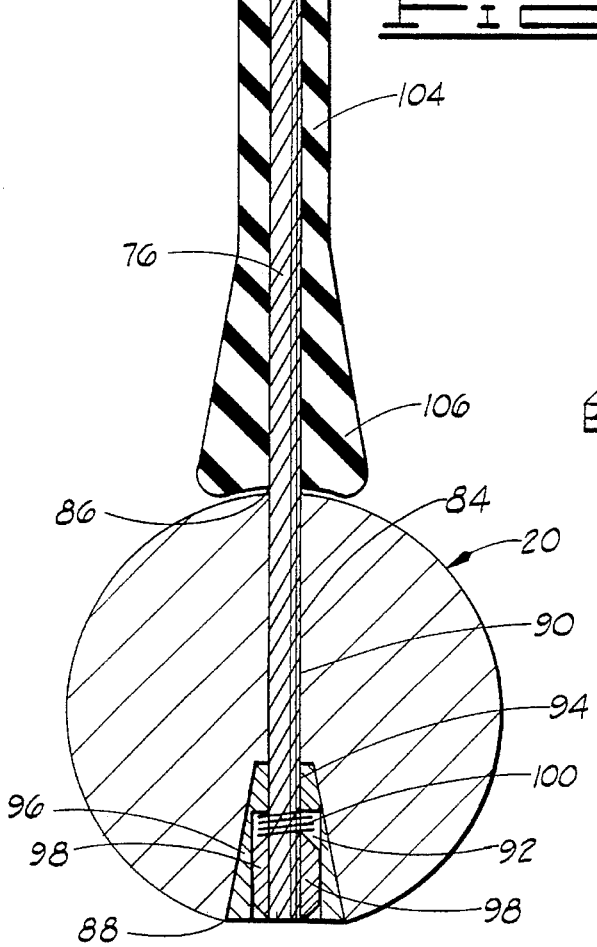

With reference to FIGS. 1 and 3, the rotation element, 18 comprises a flat oval-shaped member, formed from a sturdy and durable material such as aluminum or steel. As shown in FIG. 3, a circular opening 62 is formed within the rotation element 62. Installed within the opening 62 is a roller bearing 64, with which the shaft 54 is engaged. The roller bearing 64 is held in place by a snap ring (not shown). Thus, the rotation element 18 is pivotally supported on the shaft 54, and is rotatable in a plane substantially orthogonal to the support arm 16.

With continued reference top FIGS. 1 and 3, at least one magnet 66 is supported on, and preferably embedded within, the rotation element 18, at a position spaced from its axis of rotation. In the embodiment shown in the Figures, a total of seven magnets 66 are embedded within the rotation element 18. However, in many instances, a lesser number of magnets, or even a single magnet, may suffice. If more than one magnet 66 is employed, they should be uniformly spaced at equal radial distances from the shaft 24.

As best shown in FIG. 1, the embedded magnets 66 project from the inboard side of the rotation element 18. As the rotation element 18 turns on the shaft 54, each magnet 66 approaches to the sensor element 58, which is positioned adjacent the rotation element 18. The measurement assembly 56, which is responsive to the magnetic field strength associated with approach of a magnet 66, can the time interval between successive magnet approaches during rotation of the rotation element 18. Suitable measurement equipment is commercially available.

The computation assembly 60 comprises computation hardware and software, which calculate, from the measured time interval between successive magnet approaches, an estimated effective hitting distance proportional to the impact with which the ball element 20 has been struck. Operation of the measurement and computation assemblies permits display of the estimated hitting distance on the digital display of the computation assembly 60 shown in FIG. 2, so that the user may evaluate his or her effective hitting distance during a session with the apparatus 10.

With reference to FIG. 3, an internal channel 68 is formed in the base of the rotation element 18. The internal channel 68 is characterized by a surface outlet 70, an enlarged section defining an internal recess 72, and a constricted section 74 intermediate the internal recess 72 and the surface outlet 70. As shown in the Figure, the internal recess 72 and the constricted section 74 are open to the outboard side of the rotation element 18, in order to permit installation of the ball suspension cable 76.

The ball suspension cable 76 is preferably formed from a strong material such as woven steel. Secured to the upper end of the ball suspension cable 76, preferably by swaging, is an upper cable stop element 78. The upper cable stop element 78, which is characterized by a cross-sectional dimension exceeding that of constricted section 74 of the internal channel 68, and is received within the internal recess 72.

When the upper cable stop element 78 is received within the internal recess 72, the adjacent upper portion of ball suspension cable 78 clearingly extends through the internal channel 68. Because of its relatively enlarged cross-sectional dimensions, the upper cable stop element 78 functions to anchor the ball suspension cable 76, at its upper end, to the rotation element 18.

Positioned within the internal recess 72 of the rotation element 18, intermediate the upper cable stop element 78 and the constricted section 74 of the internal channel 68, is an upper spring 80. The upper spring 80, which preferably is coiled around the ball suspension cable 76, functions to cushion the apparatus 10 from the impact of hits against the ball element 20 while the apparatus 10 is in use.

As mentioned above, the internal recess 72 may be opened to the outboard side of the rotation element 18, in order to permit installation of the ball suspension cable 76. Once the ball suspension cable 76 has been installed, however, the internal recess 72 is preferably closed by a plate (not shown) which is secured to the outboard surface of the rotation element 18. The plate is preferably secured to the outboard surface of the rotation element 18 by connectors, such as screws, which are threaded into openings 82 adjacent the internal recess 72.

With continued reference to FIG. 3, the ball element 20 comprises a ball formed from rubber or a solid elastomer. In the embodiment shown in the Figure, the ball is softball-sized; in another embodiment, to be described hereafter, the ball may be hardball-sized.

Formed within the ball element 20 is an axial internal passage 84 having a first surface outlet 86 and an opposed second surface outlet 88. Intermediate the first and second surface outlets 86 and 88 is an internal channel 90, through which the ball suspension cable 76 clearingly extends.

The internal channel 90 is characterized by an enlarged section comprising an internal chamber 92 adjacent the second surface outlet 88, and a constricted section 94 intermediate the internal chamber 92 and the first surface outlet 88.

As shown in FIG. 3, the internal channel 90 and internal chamber 92 preferably comprise recess formed within an elongate plug element 96, formed from a material such as aluminum, which is implanted within the internal passage 84 of the ball element 20. Implantation may be performed with a reamer or a similar tool.

The ball suspension cable 76, adjacent its lower end, clearingly extends through the internal channel 90 and internal chamber 92. Secured to the lower end of the ball suspension cable 76, preferably by swaging, is an lower cable stop element 98. The lower cable stop element 98, which is characterized by a cross-sectional dimension exceeding that of the constricted section 94 of the internal channel 90, is clearingly received within the internal chamber 92.

Because of its enlarged cross-sectional dimensions, relative to the constricted section 94, the lower cable stop element 98 functions to anchor the ball suspension cable 76, at its lower end, to the ball element 20. At the same time, the sizing of the lower cable stop element 98 permits rotation of the ball element 18 with respect to the lower cable stop element 98 and ball suspension cable 76.

Positioned within the internal chamber 92 of the ball element 20, intermediate the lower cable stop element 98 and the constricted section 94 of the internal channel 90, is a lower spring 100. The lower spring 100, which preferably is coiled around the ball suspension cable 76, functions to cushion the ball element 20 against downward impacts experienced during use of the apparatus 10.

The second surface outlet 88 of the ball element 20 must be open during installation of the ball suspension cable 76 and lower cable stop element 98. Once installation is complete, however, the second surface outlet is preferably covered, preferably by a leather ball covering 102 such as that shown in FIG. 1.

As best shown in FIG. 3, the apparatus 10 preferably further comprises a cable protection shield 104, formed from a sturdy, impact-resistant material such as rubber or polymeric foam. The cable protection shield 104 covers at least a portion of the ball suspension cable 76 which would otherwise be exposed adjacent the first surface outlet 84 of the internal channel 90.

The cable protection shield 104 features a flared base section 106 adjacent the surface of the ball element 18. The flaring of the base section 106 tends to deflect misguided bats or other hitting instruments toward the ball element 20. Such deflection serves to minimize damage to the ball suspension cable 76 while the apparatus 10 is in use.

Figure 5:
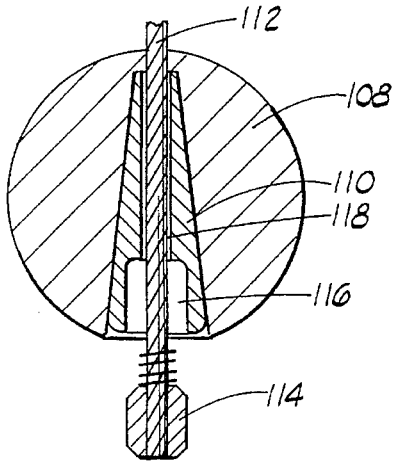
FIG. 5 is a side cross-sectional view of a partially disassembled ball element of another embodiment of the present invention, in which the ball element is hardball-sized. The lower cable stop element is positioned outside the internal chamber of the ball element, in order to permit better display of other components.

FIG. 5 shows another embodiment of the present invention in which the ball element 108 is hardball-sized. The plug element 110 in this embodiment traverses substantially the entire diameter of the ball element 108. The Figure depicts the ball suspension cable 112 and the lower cable stop element 114 during assembly of the apparatus. This configuration permits better display of the relationship between the lower cable stop element 114, the internal chamber 116, and the constricted section 118 of the internal passage.

In operation, the user positions the stand assembly 12 on a desired ground location, using the sight level 50, if necessary, to level the apparatus 10. The telescoping tower assembly 14 is used to position the ball element 20 at a desired height, depending on the height of the user and user's practice requirements. The user then strikes the ball element, which depends from the rotation element 18, with a baseball bat, or other hitting instrument. The impact causes the ball element 20, and the attached rotation element 18, to rotate on the shaft 54. The user may monitor the estimated effective distance of the hit by use of the display readout of the computation assembly 60.

Changes may be made in the construction, operation and arrangement of the various parts, elements, steps and procedures described herein without departing from the spirit and scope of the invention as defined in the following claims.

What is claimed is:

1. A hitting practice apparatus comprising:

a horizontal support arm;

a rotation element, pivotally supported on the support arm and rotatable in a plane substantially orthogonal to the support arm;

a unitary ball suspension cable having an upper end, secured to the rotation element, and a lower end;

a ball element comprising a ball having an axial internal passage, the passage characterized by opposed first and second surface outlets and an internal channel through which the ball suspension cable is clearingly extended, the internal channel having an enlarged section comprising an internal chamber adjacent the second surface outlet, and a constricted section intermediate the internal chamber and the first surface outlet;

a lower cable stop element, secured to the lower end of the ball suspension cable and positioned within the internal chamber, the lower cable stop element having a cross-sectional dimension exceeding that of the constricted section of the internal channel, while permitting rotation of the ball element with respect to the lower cable stop element and ball suspension cable; and a lower spring, positioned within the internal chamber of the ball element intermediate the lower cable stop element and the constricted section of the internal channel.

2. The apparatus of claim 1, further comprising:

a cable protection shield covering at least a portion of the ball suspension cable which would otherwise be exposed adjacent the first surface outlet of the internal channel of the ball element and having a flared base section adjacent the surface of the ball element.

3. The apparatus of claim 1, further comprising:

at least one magnet supported on the rotation element, at a position spaced from its axis of rotation; and means, supported adjacent the rotation element and responsive to the magnetic field strength associated with the approach of magnet, for measuring the time interval between successive magnet approaches during rotation of the rotation element.

4. The apparatus of claim 1, in which the rotation element is characterized as having an internal channel through which the ball suspension cable is clearingly extended adjacent its upper end, the channel characterized by a surface outlet, an enlarged section defining an internal recess, and a constricted section intermediate the internal recess and the surface outlet, and further comprising:

an upper cable stop element, secured to the upper end of the ball suspension cable and positioned within the internal recess of the rotation element, the lower cable stop element having a cross-sectional dimension exceeding that of constricted section of the internal channel.

5. The apparatus of claim 4, further comprising: an upper spring, positioned within the internal recess of the rotation element intermediate the upper cable stop element and the constricted section of the internal channel.

6. The apparatus of claim 1 in which the ball element is the size of a baseball.

7. The apparatus of claim 1 in which the ball element is the size of a softball.

8. The apparatus of claim 1, further comprising:

an elongate plug element, implanted within the internal passage of the ball element, the plug element having internal recesses which define the internal channel and internal chamber within which the ball suspension cable is clearingly received adjacent its lower end.

9. The apparatus of claim 8 in which the ball element is the size of a baseball.

10. The apparatus of claim 8 in which the ball element is the size of a softball.

11. The apparatus of claim 1 in which the ball element is formed from rubber or a solid elastomer.

12. A hitting practice apparatus comprising:

a horizontal support arm;

a rotation element, pivotally supported on the support arm and rotatable in a plane substantially orthogonal to the support arm, and having an internal channel formed therein, the channel characterized by a surface outlet, an enlarged section defining an internal recess, and a constricted section intermediate the internal recess and the surface outlet, and further comprising:

an upper cable stop element positioned within the internal recess of the rotation element, the lower cable stop element having a cross-sectional dimension exceeding that of constricted section of the internal channel; and an upper spring, positioned within the internal recess of the rotation element intermediate the upper cable stop element and the constricted section of the internal channel;

a ball suspension cable which clearingly extends though the internal channel of the rotation element, and having an upper end secured to the upper cable stop element, and a lower end;

a ball element comprising a ball having an axial internal passage, the passage characterized by opposed first and second surface outlets and an internal channel through which the ball suspension cable is clearingly extended, the internal channel having an enlarged section comprising an internal chamber adjacent the second surface outlet, and a constricted section intermediate the internal chamber and the first surface outlet; and a lower cable stop element, secured to the lower end of the ball suspension cable and positioned within the internal chamber, the lower cable stop element having a cross-sectional dimension exceeding that of the constricted section of the internal channel, while permitting rotation of the ball element with respect to the lower cable stop element and ball suspension cable.

* * * * *